US010470535B2

(12) United States Patent
Sierra et al.

(10) Patent No.: US 10,470,535 B2
(45) Date of Patent: Nov. 12, 2019

(54) DEVICE FOR TRACKING MENSTRUAL CYCLE

(71) Applicant: Be Girl, Inc., Brooklyn, NY (US)

(72) Inventors: Diana Sierra, North Bergen, NJ (US); Pablo Freund, Brooklyn, NY (US); Victoria C. Spriggs, Spanish Fort, AL (US); Maria Paula Navia, Los Angeles, CA (US)

(73) Assignee: BE GIRL, INC., Brooklyn, NY (US)

( * ) Notice: Subject to any disclaimer, the term of this patent is extended or adjusted under 35 U.S.C. 154(b) by 177 days.

(21) Appl. No.: 15/401,015

(22) Filed: Jan. 7, 2017

(65) Prior Publication Data

US 2017/0215528 A1 Aug. 3, 2017

Related U.S. Application Data

(63) Continuation of application No. 15/162,222, filed on May 23, 2016, now abandoned, which is a continuation of application No. 14/964,560, filed on Dec. 9, 2015, now abandoned.

(60) Provisional application No. 62/090,039, filed on Dec. 10, 2014.

(51) Int. Cl.

| | |
|---|---|
| ***A44C 25/00*** | (2006.01) |
| ***A44C 5/00*** | (2006.01) |
| ***A44C 15/00*** | (2006.01) |

(52) U.S. Cl.

CPC ..... *A44C 25/001* (2013.01); *A44C 5/0015* (2013.01); *A44C 15/005* (2013.01)

(58) Field of Classification Search

CPC .... A44C 5/0015; A44C 25/001; A44C 15/005
USPC ..... 235/85 FC, 78 RC, 88 RC; 206/534; 221/5

See application file for complete search history.

(56) References Cited

U.S. PATENT DOCUMENTS 566,617 A * 8/1896 Patterson ..... A44C 3/001 40/1.6
2,812,604 A * 11/1957 Nelson ..... A44C 9/003 40/111
3,619,923 A * 11/1971 Bruner ..... A44C 5/0015 40/118
4,232,215 A * 11/1980 Hanley ..... A61B 10/0012 235/78 RC (Continued)

*Primary Examiner* — Abigail E Troy
(74) *Attorney, Agent, or Firm* — Duane Morris LLP; Thomas J. Kowalski; Deborah L Lu

(57) ABSTRACT

A wearable device allows women to track their menstrual cycle by rotating or sliding a marker that will tell her every day where she is in her menstrual cycle. This device can be shaped in multiple ways. In general, the device has two or more interlocking pieces that allow the user to manually move, e.g., rotate or slide, a marker shaped on one of the pieces with respect to the other piece to highlight indicia, such as a number or icon or color, that represents a day in the menstrual cycle. The indicia can be hidden within the design to protect the user's privacy. In one implementation, the device is attached to a chain, rope or other form allowing it to be worn around the neck, typically under the clothes, like a pendant. Another implementation is shaped like a bracelet, allowing it to be work around the wrist. Other configurations to be worn on other parts of the body also are possible.

8 Claims, 13 Drawing Sheets

(56) References Cited

U.S. PATENT DOCUMENTS

| | | | | |
|---|---|---|---|---|
| 6,585,663 | B1 * | 7/2003 | Coley | A61B 10/0012 600/300 |
| 6,747,917 | B2 * | 6/2004 | Jennings | A61B 10/0012 24/116 A |
| 7,313,929 | B2 * | 1/2008 | Lazor | A44C 5/0007 116/278 |
| 7,588,544 | B2 * | 9/2009 | Mulcaire-Jones | A61B 10/0012 600/551 |
| 2005/0038005 | A1 * | 2/2005 | Boissonneault | A61K 31/56 514/170 |

* cited by examiner

DEVICE FOR TRACKING MENSTRUAL CYCLE

CROSS-REFERENCE TO RELATED APPLICATIONS

This application is a continuation of U.S. patent application Ser. No. 15/162,222, filed May 23, 2016, pending, which is a continuation of U.S. patent application Ser. No. 14/964,560, filed Dec. 9, 2015, abandoned, which is a nonprovisional application claiming priority to and the benefits of prior U.S. provisional patent application 62/090,039, filed Dec. 10, 2014, which are hereby incorporated by reference.

BACKGROUND

There are a variety of techniques that women have used to track where they are in their menstrual cycles. An example is counting beads.

SUMMARY

This Summary is provided to introduce a selection of concepts in a simplified form that are further described below in the Detailed Description. This Summary is intended neither to identify key or essential features, nor to limit the scope, of the claimed subject matter.

A wearable device allows women to track their menstrual cycle by rotating or sliding a marker that will tell her every day where she is in her menstrual cycle. This device can be shaped in multiple ways. In general, the device has two or more interlocking pieces that allow the user to manually move, e.g., rotate or slide, a marker shaped on one of the pieces with respect to the other piece to highlight indicia, such as a number or icon or color, that represents a day in the menstrual cycle. The indicia can be hidden within the design to protect the user's privacy. In one implementation, the device is attached to a chain, rope or other form allowing it to be worn around the neck, typically under the clothes, like a pendant. Another implementation is shaped like a bracelet, allowing it to be work around the wrist. Other configurations to be worn on other parts of the body also are possible.

In the following description, reference is made to the accompanying drawings which form a part hereof, and in which are shown, by way of illustration, specific example implementations. Other implementations and structural changes can be made without departing from the scope of the disclosure.

DETAILED DESCRIPTION

A wearable device allows women to track their menstrual cycle by rotating or sliding a marker that will tell her every day where she is in her menstrual cycle. This device can be shaped in multiple ways. In general, the device has two or more interlocking pieces that allow the user to manually move, e.g., rotate or slide, a marker shaped on one of the pieces with respect to the other piece to highlight indicia, such as a number or icon or color, that represents a day in the menstrual cycle. The indicia can be hidden within the design to protect the user's privacy. The indicia generally represent the fact that there are roughly 27+/−3 days in the menstrual cycle.

The following are descriptions of several example implementations of such a wearable device.

Figure 1:
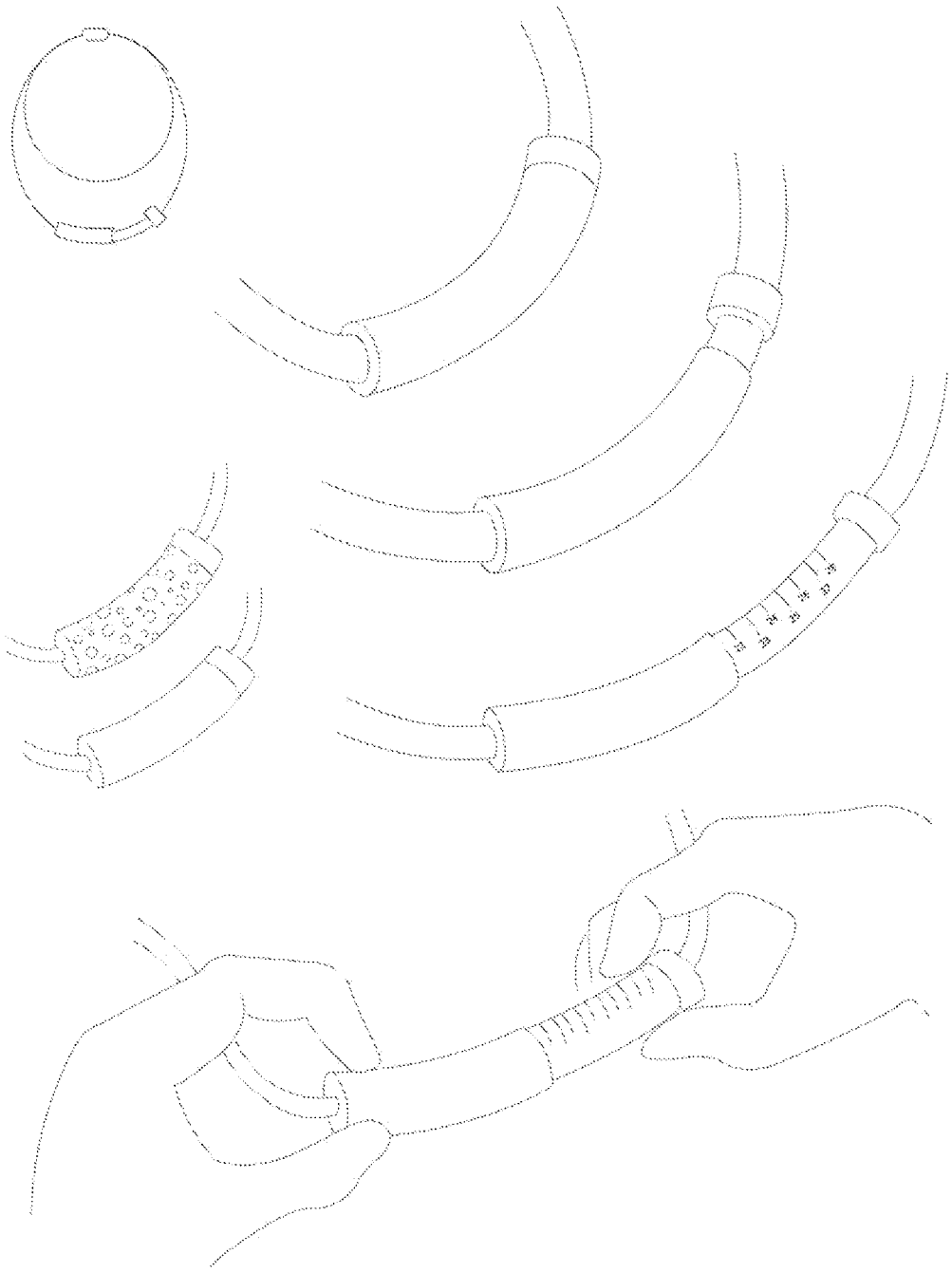
FIG. 1 illustrates a first implementation of a wearable device.

FIG. 1 illustrates a first implementation of a wearable device. In this implementation, a first piece is arcuate and tubular and has indicia of the menstrual cycle, in the form of 27+/−3 counting measures. A second arcuate and tubular piece interlocks with the first piece and is movable along the first piece. An edge of the second piece acts as a marker that reveals the current day on the menstrual cycle by being adjacent to one of the counting measures on the first piece. The tubular shape allows the device to be placed on a cord, chain, rope or the like, allowing it to be worn as a necklace.

Figure 2:
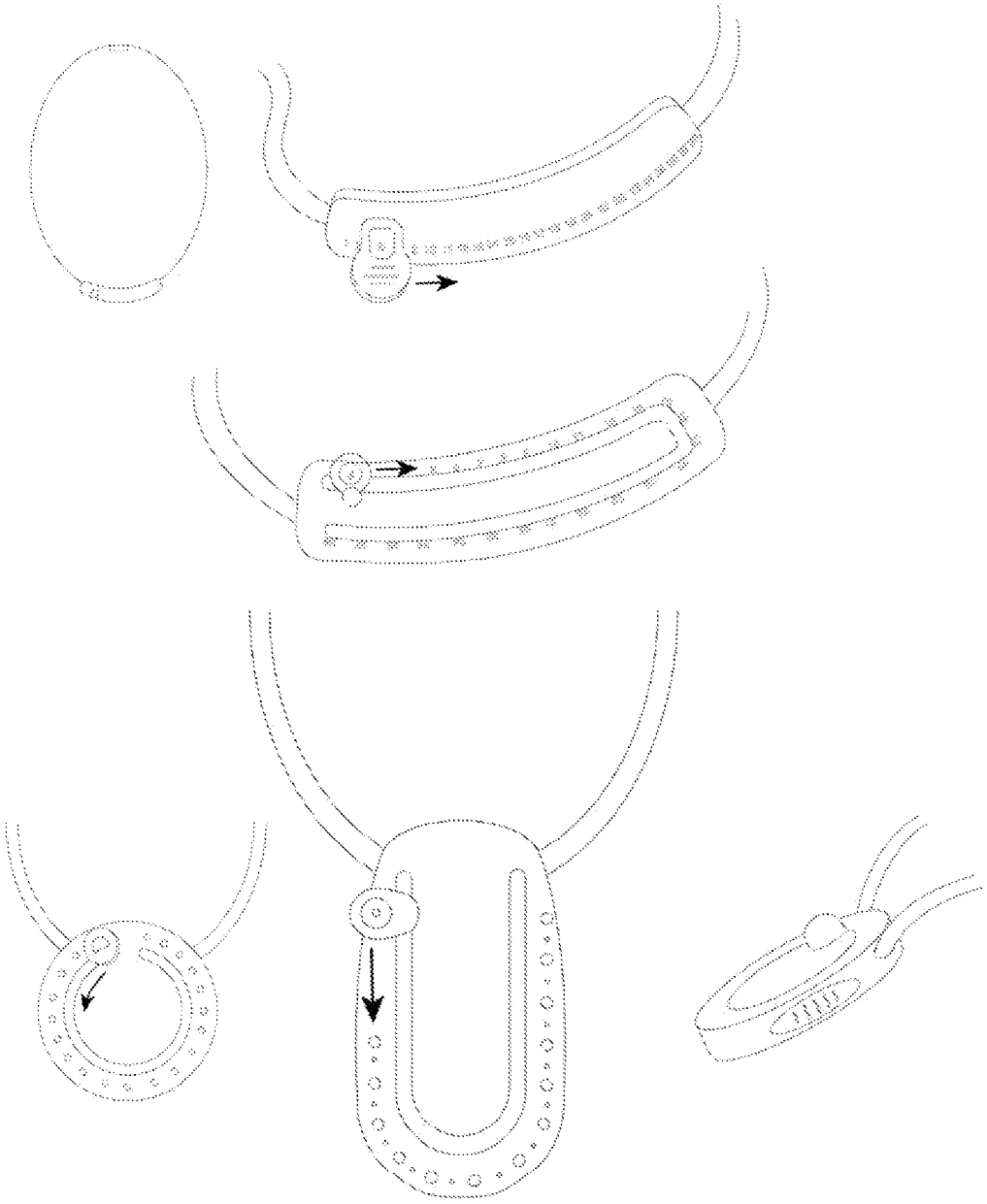
FIG. 2 illustrates a second implementation of a wearable device.

FIG. 2 illustrates a second implementation of a wearable device. In this implementation, a first piece can be in any of a number of shapes, such as an arcuate shape, circular shape or oblong shape. The first piece has indicia of the menstrual cycle, in the form of 27+/−3 counting measures along a track. The track can be linear, arcuate, u-shaped, c-shaped, a circle or the like. A second piece is a clip that interlocks with the first piece and is movable along the track in first piece. An edge of a shape formed in the second piece creates a window that acts as a marker that reveals the current day on the menstrual cycle by being encircling one of the counting measures on the first piece. The first piece can have a passage formed in it that allows the device to be placed on a cord, chain, rope or the like, allowing it to be worn as a necklace.

Figure 3:
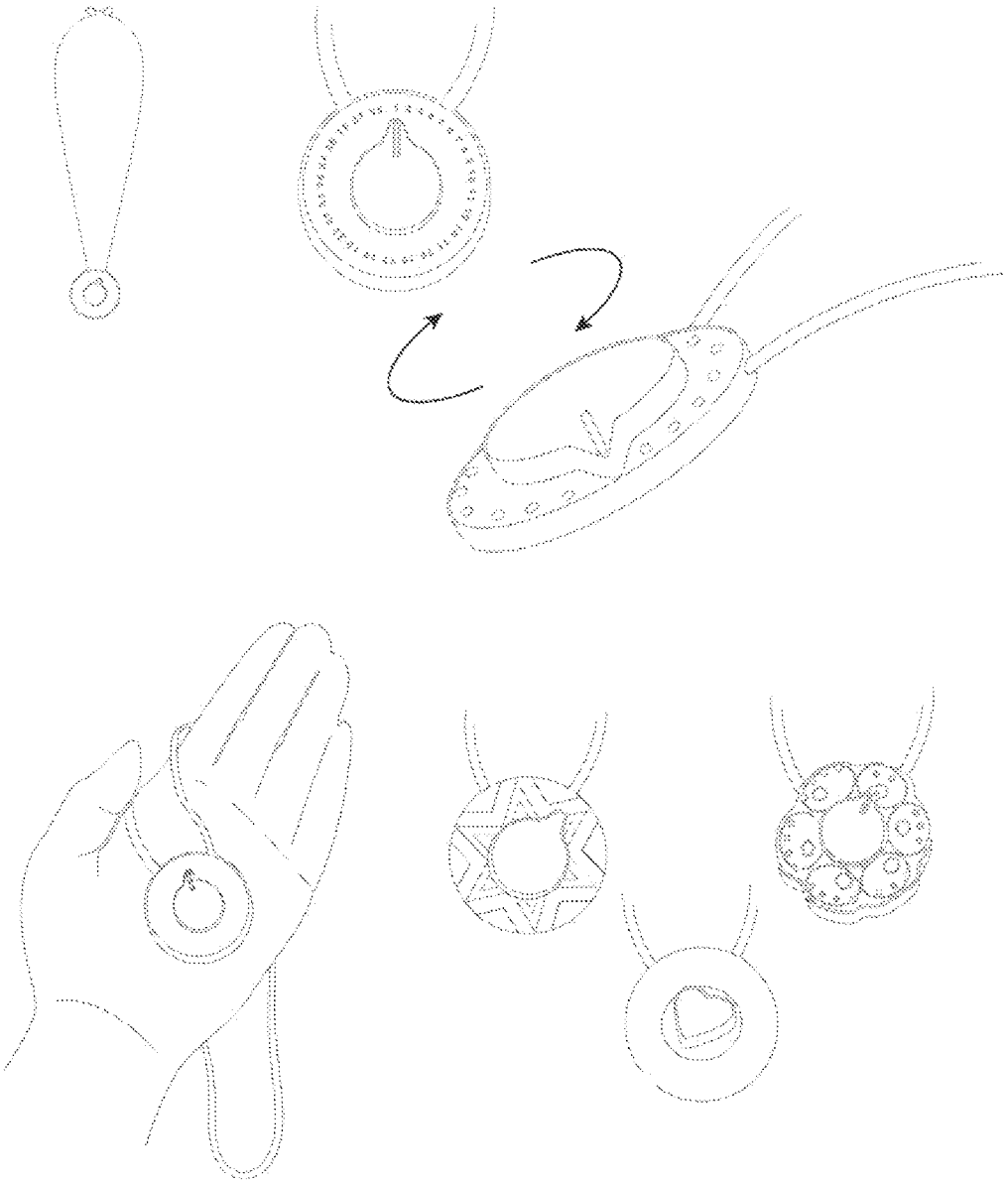
FIG. 3 illustrates a third implementation of a wearable device.

FIG. 3 illustrates a third implementation of a wearable device. In this implementation, a first piece can be in any of a number of shapes, such as a circular shape, flower shape or other geometric pattern. The first piece has indicia of the menstrual cycle, in the form of 27+/−3 counting measures in a circle or arc. A second piece is a form of dial that interlocks with the first piece and is rotatable with respect to the first piece. A marker, such as a triangle shaped extension on the dial, formed in the second piece forms a point that that acts as a marker that reveals the current day on the menstrual cycle by pointing to one of the counting measures on the first piece. The first piece can have a passage formed in it that allows the device to be placed on a cord, chain, rope or the like, allowing it to be worn as a necklace.

Figure 4:
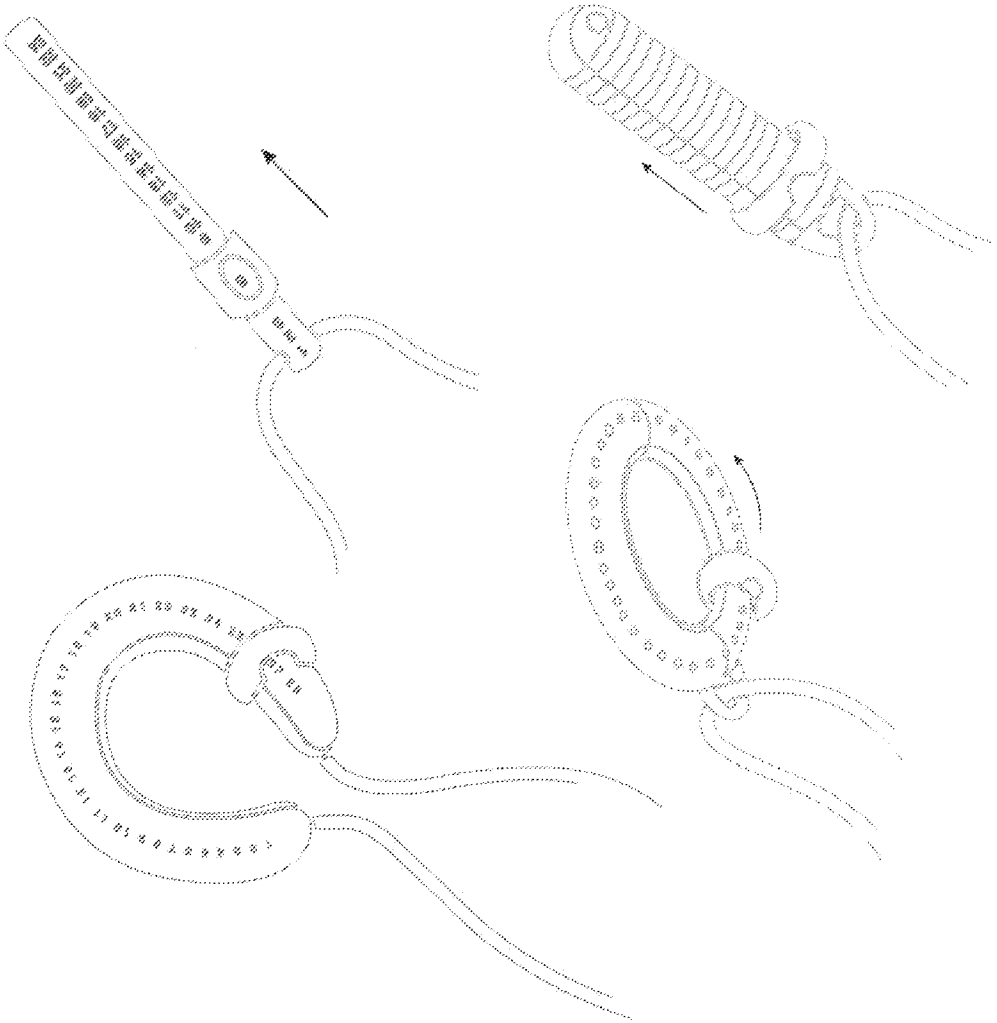
FIG. 4 illustrates a fourth implementation of a wearable device.

FIG. 4 illustrates a fourth implementation of a wearable device. In this implementation, a first piece can be in any of a number of shapes, such as a rod shape, ring shape or u-shape. The first piece has indicia of the menstrual cycle, in the form of 27+/−3 counting measures spaced along the shape of the first piece, along a range where the first piece has a constant cross section. A second piece is a clip or ring that interlocks with the first piece by having an inner perimeter that matches the cross section of the first piece. The second piece is movable by sliding along the exterior in first piece. An edge of a shape formed in the second piece, such as a notch or point or window shape, acts as a marker that reveals the current day on the menstrual cycle by highlighting one of the counting measures on the first piece. The first piece can have a passage formed in it that allows the device to be placed on a cord, chain, rope or the like, allowing it to be worn as a necklace.

Figure 5:
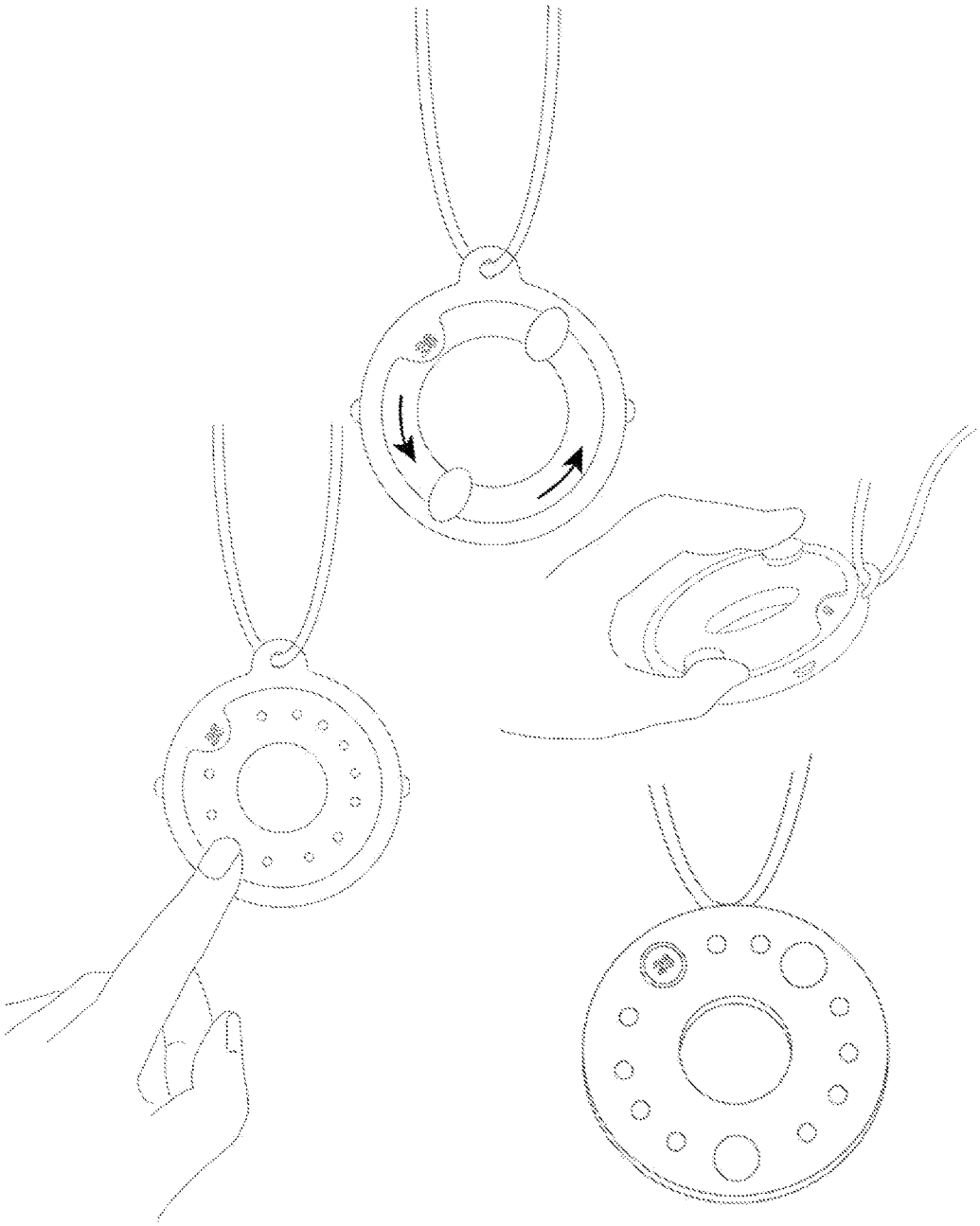
FIG. 5 illustrates a fifth implementation of a wearable device.

FIG. 5 illustrates a fifth implementation of a wearable device. In this implementation, a first piece has a circular shape, flower shape or other geometric pattern. The first piece has indicia of the menstrual cycle, in the form of 27+/−3 counting measures in a circle. The second piece is a form of dial that interlocks with the first piece and is rotatable with respect to the first piece. A marker, such as a notch or window on the dial, formed in the second piece acts as a marker that reveals the current day on the menstrual cycle by highlighting one of the counting measures on the first piece. In this implementation other counting measures are hidden, and only the current counting measure is shown. The first piece can have a passage formed in it that allows the device to be placed on a cord, chain, rope or the like, allowing it to be worn as a necklace.

Figure 6:
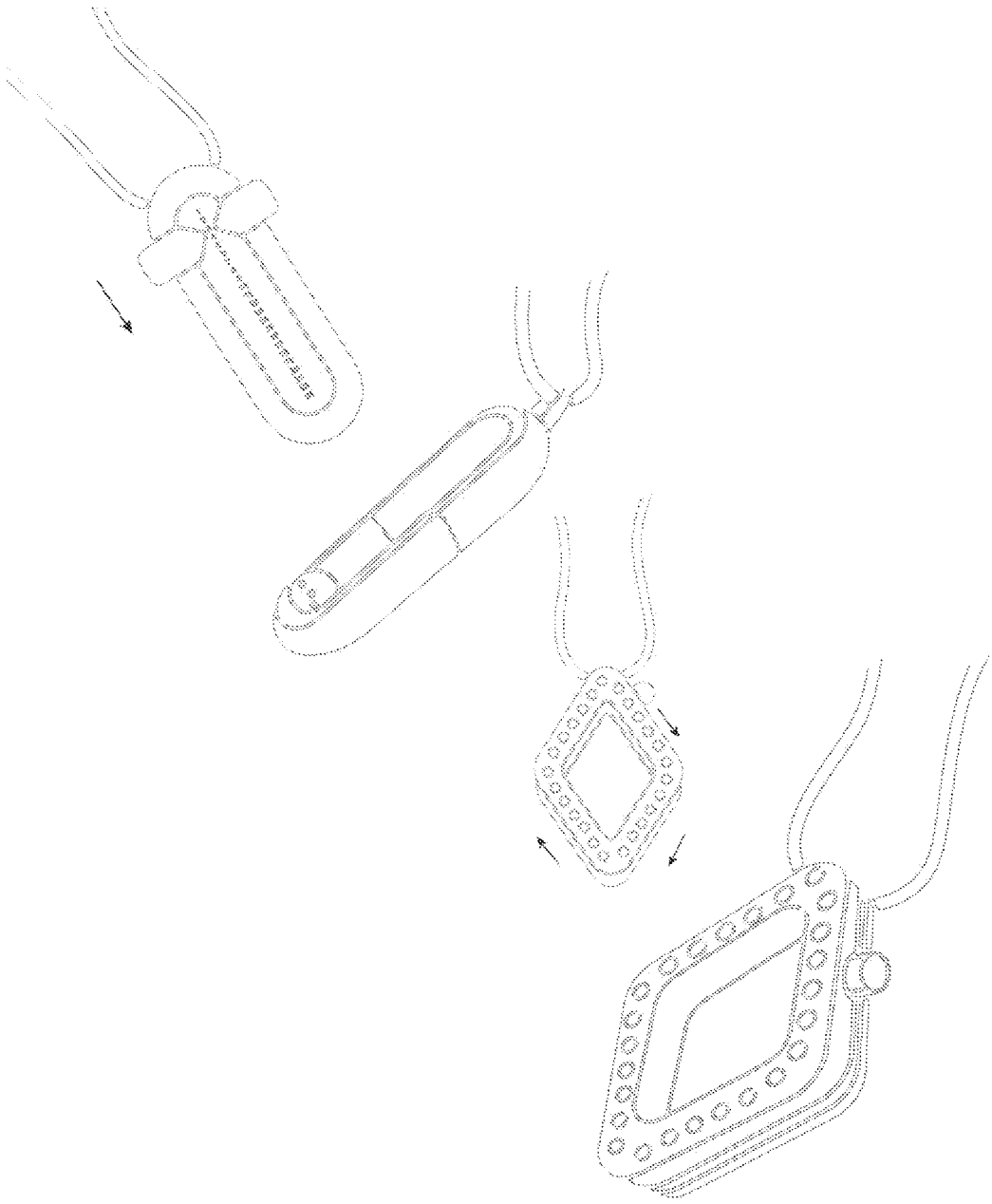
FIG. 6 illustrates a sixth implementation of a wearable device.

FIG. 6 illustrates a sixth implementation of a wearable device. In this implementation, a first piece can be in any of a number of shapes, such as a rod shape, diamond shape, or other geometric pattern. The first piece has indicia of the menstrual cycle, in the form of 27+/−3 counting measures in a line, or around an edge of the geometric pattern. The second piece can take a variety of shapes, such as a ball, c-clip or button, that interlocks with a track the first piece and is movable along the track with respect to the first piece. A marker, which can be the entire second piece, or points formed on the second piece, act as a marker that reveals the current day on the menstrual cycle by pointing to one of the counting measures on the first piece. The first piece can have a passage formed in it that allows the device to be placed on a cord, chain, rope or the like, allowing it to be worn as a necklace.

Figure 7:
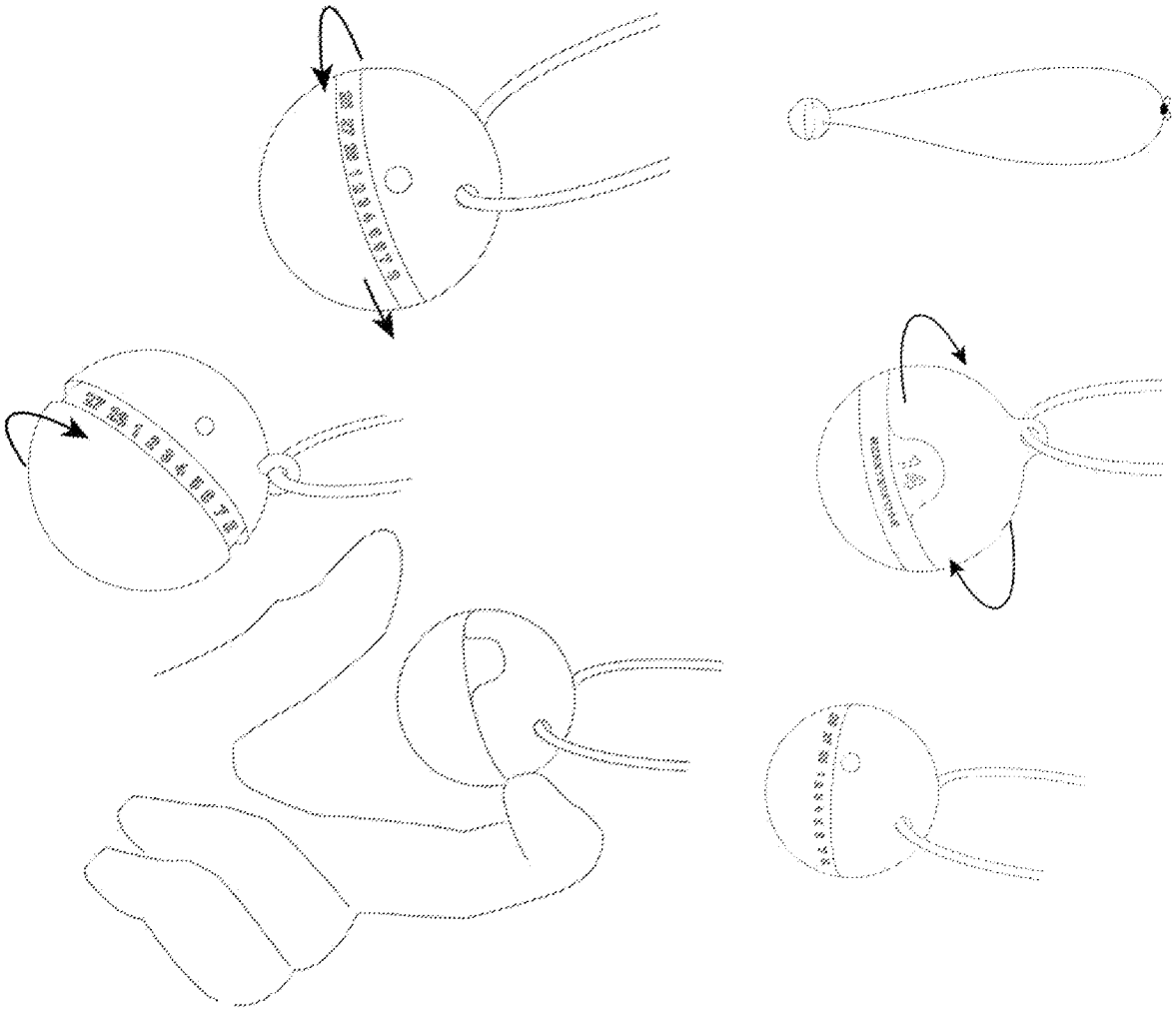
FIG. 7 illustrates a seventh implementation of a wearable device.

FIG. 7 illustrates a seventh implementation of a wearable device. In this implementation, a first piece can have a spherical shape. The first piece has indicia of the menstrual cycle, in the form of 27+/−3 counting measures in a circle or arc on the surface of the sphere. The second piece can be a form of ring that interlocks with the first piece and is rotatable with respect to the first piece. The second piece can be a partial sphere that interlocks with the first piece and is rotatable with respect to the first piece. Alternatively, the first piece may be a partial sphere with counting measures and the second piece can be a sphere that rotates with respect to the first piece. Alternatively, both the first piece and the second piece can be partial spheres that interlock to create a sphere-shaped device. A marker, such as a notch shape or raised dot marker on a partial sphere acts as a marker that reveals the current day on the menstrual cycle by revealing or pointing to one of the counting measures on the first piece. The first piece, the second piece, or both, can have a passage formed in it that allows the device to be placed on a cord, chain, rope or the like, allowing it to be worn as a necklace.

Figure 8:
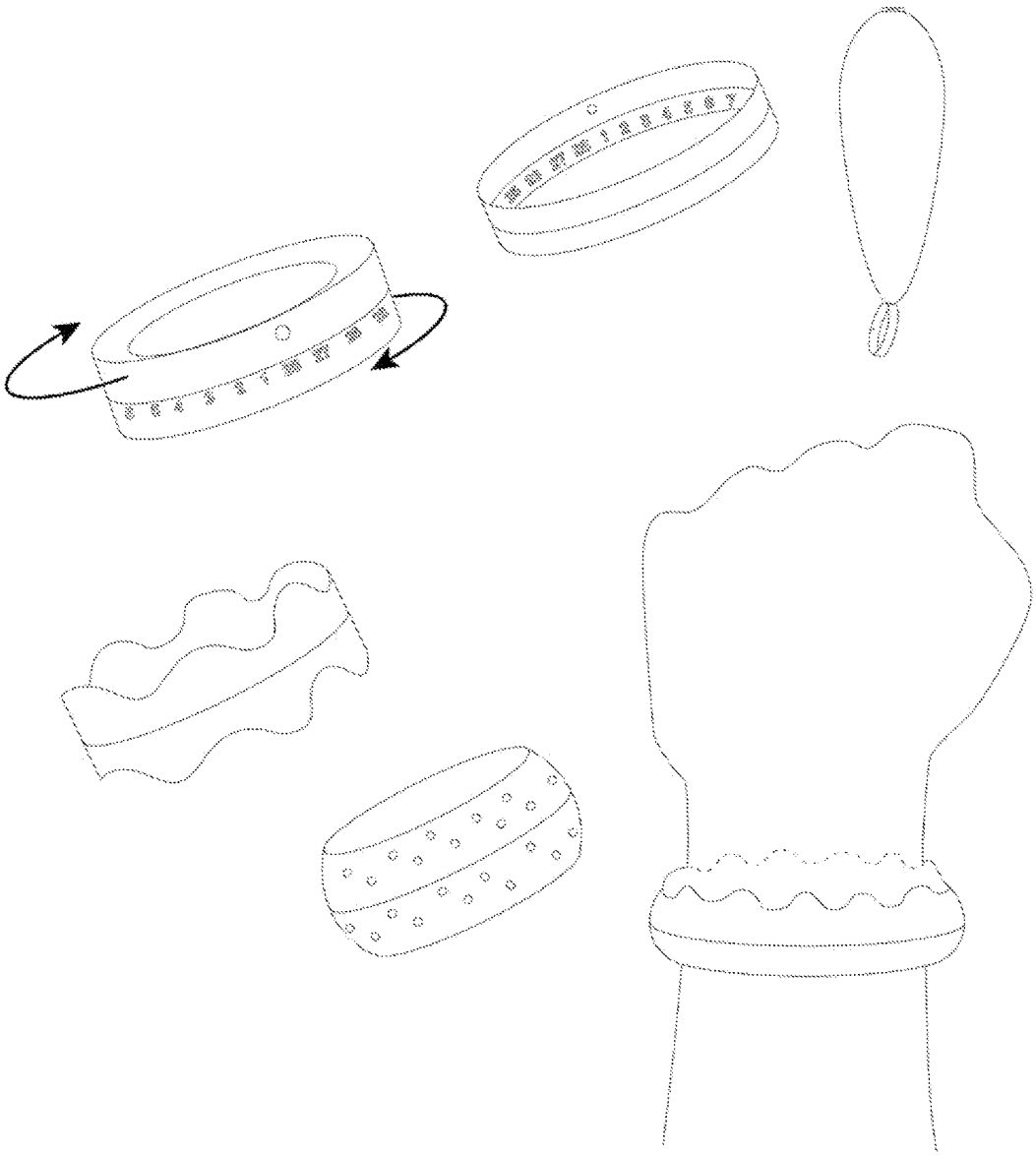
FIG. 8 illustrates an eighth implementation of a wearable device.

FIG. 8 illustrates an eighth implementation of a wearable device. In this implementation, both a first piece and a second piece are interlocking ring shapes, and the pieces are rotatable with respect to each other. Edges and faces of the first and second pieces that interlock generally form a circle. Exterior edges can be otherwise ornamental. The first piece has indicia of the menstrual cycle, in the form of 27+/−3 counting measures in a circle or arc on a surface of the ring. The second piece interlocks with the first piece and is rotatable with respect to the first piece. A marker, such as a notch shape or raised dot marker or window on the second piece, reveals the current day on the menstrual cycle by revealing or pointing to one of the counting measures on the first piece. The ring shape forms a passage allowing the device to be placed on a wrist, allowing it to be worn as a bracelet. The passage also allows the device to be placed on a cord, chain, rope or the like, allowing it to be worn as a necklace.

Figure 9:
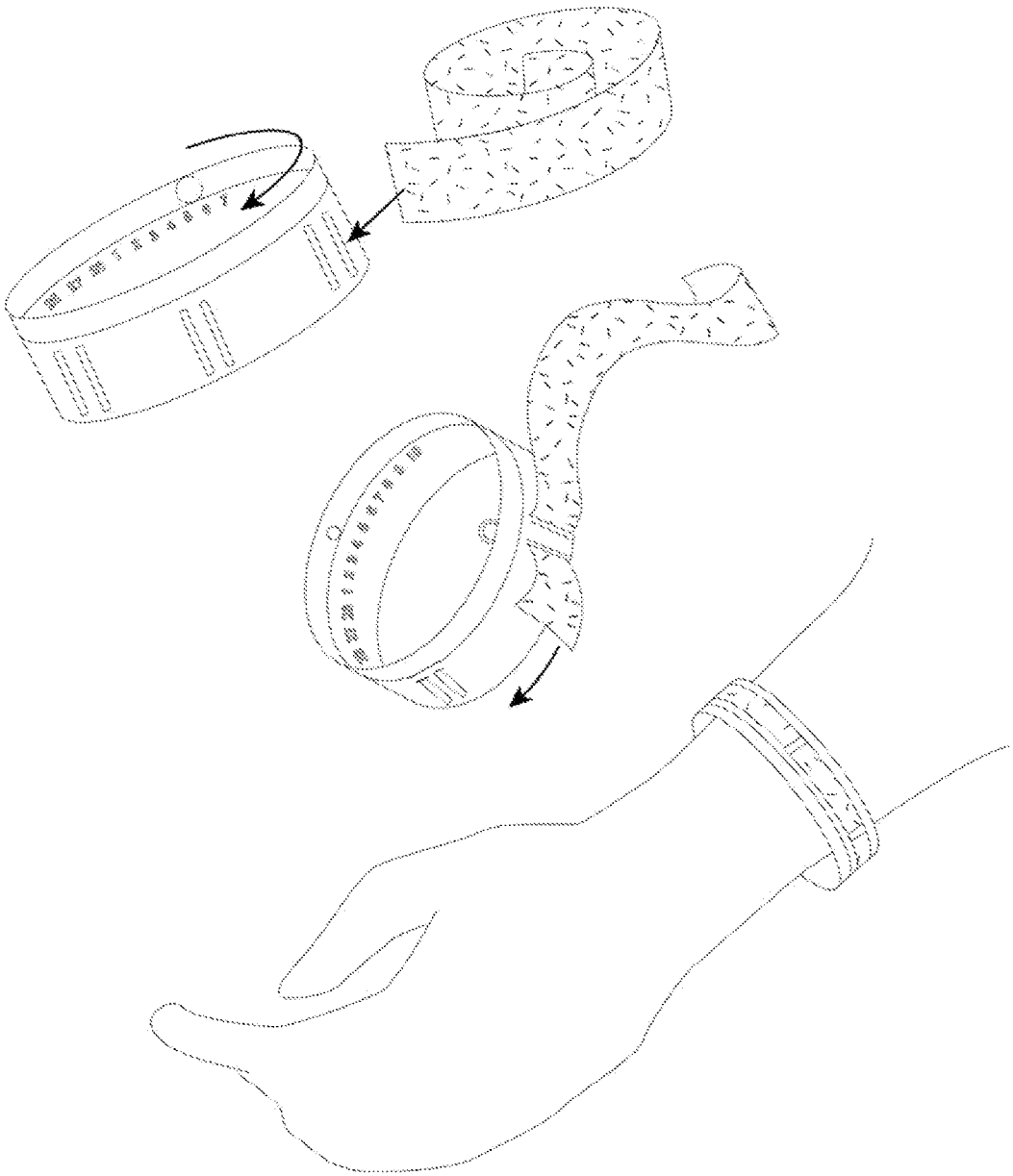
FIG. 9 illustrates a ninth implementation of a wearable device.

FIG. 9 illustrates a ninth implementation of a wearable device. This implementation is similar to the ring-shaped devices shown FIG. 8. In addition several slots allow decorative ribbons or other ornamental material to be placed along the exterior of the device. The counting measures can be on an interior face of the ring so they are not visible when the device is worn as a bracelet.

Figure 10:
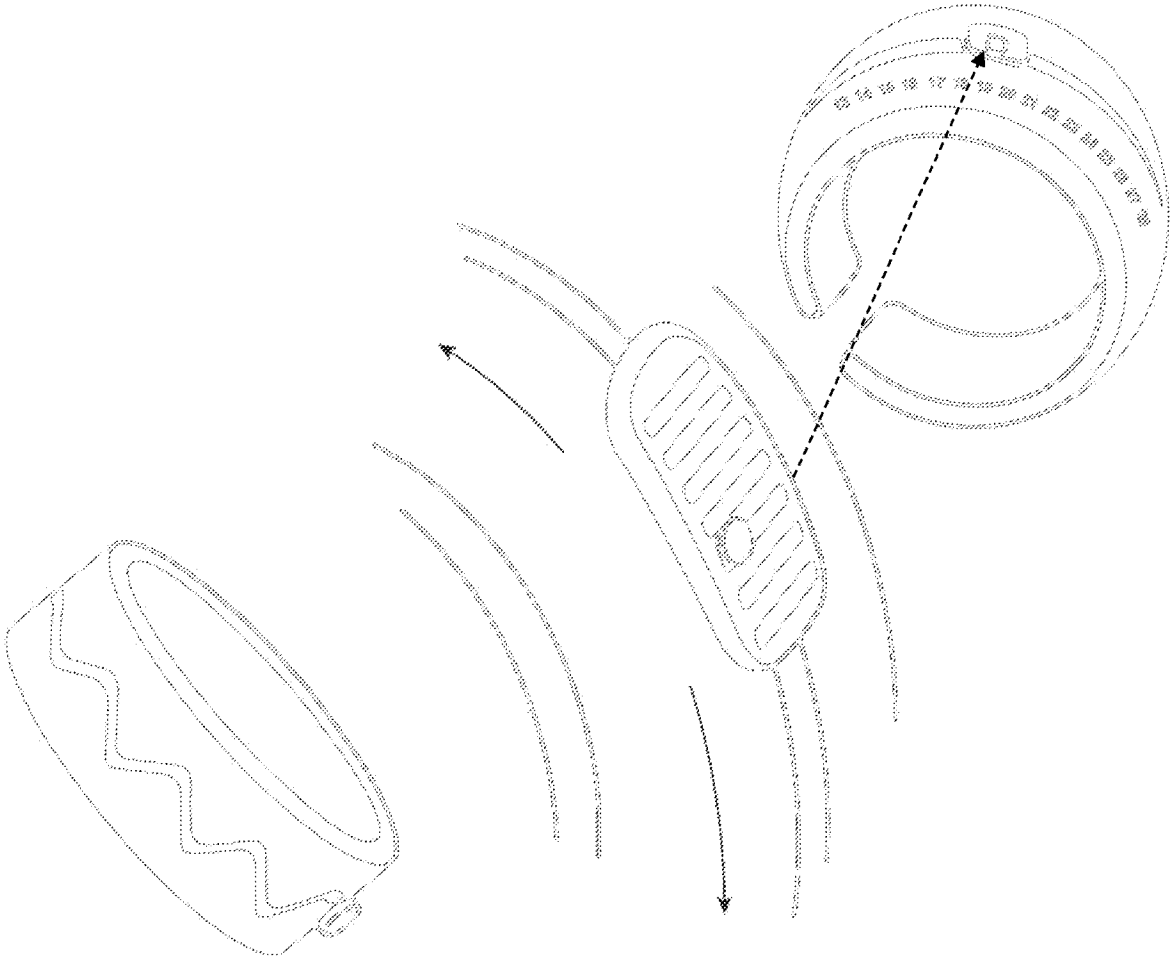
FIG. 10 illustrates a tenth implementation of a wearable device.

FIG. 10 illustrates a tenth implementation of a wearable device. In this implementation, a first piece is C-shaped and has a track. The first piece has indicia of the menstrual cycle, in the form of 27+/−3 counting measures in a circle or arc on a surface of the first piece and adjacent the track. The second piece interlocks with the first piece in the track and is movable along the track with respect to the first piece. The track, as in other implementations, can be any of a variety of shapes, such as a linear or zig-zag shape as shown. A marker, such as a notch shape or raised dot marker or window on the second piece, reveals the current day on the menstrual cycle by revealing or pointing to one of the counting measures on the first piece. The c-shape of the first piece forms a passage allowing the device to be placed on a wrist, allowing it to be worn as a bracelet.

Figure 11:
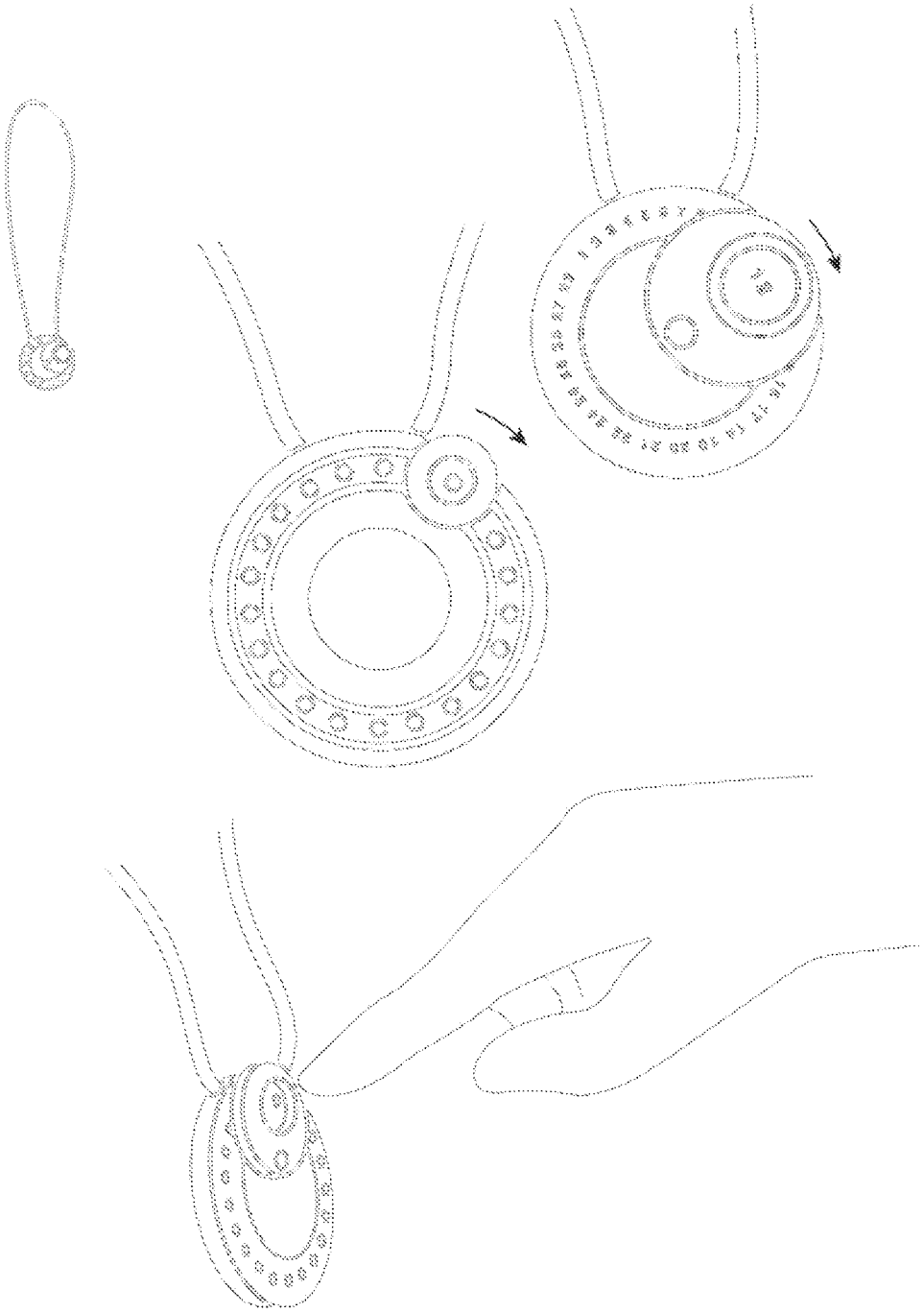
FIG. 11 illustrates an eleventh implementation of a wearable device.

FIG. 11 illustrates an eleventh implementation of a wearable device. In this implementation, a first piece has a circular shape. The first piece has indicia of the menstrual cycle, in the form of 27+/−3 counting measures in a circle or arc. A second piece is a form of dial that interlocks with the first piece and is rotatable with respect to the first piece, or movable along one or more tracks of the first piece. A marker, such as a window formed in the second piece, highlights the current day on the menstrual cycle forming a window around one of the counting measures on the first piece. The first piece can have a passage formed in it that allows the device to be placed on a cord, chain, rope or the like, allowing it to be worn as a necklace.

Figure 12:
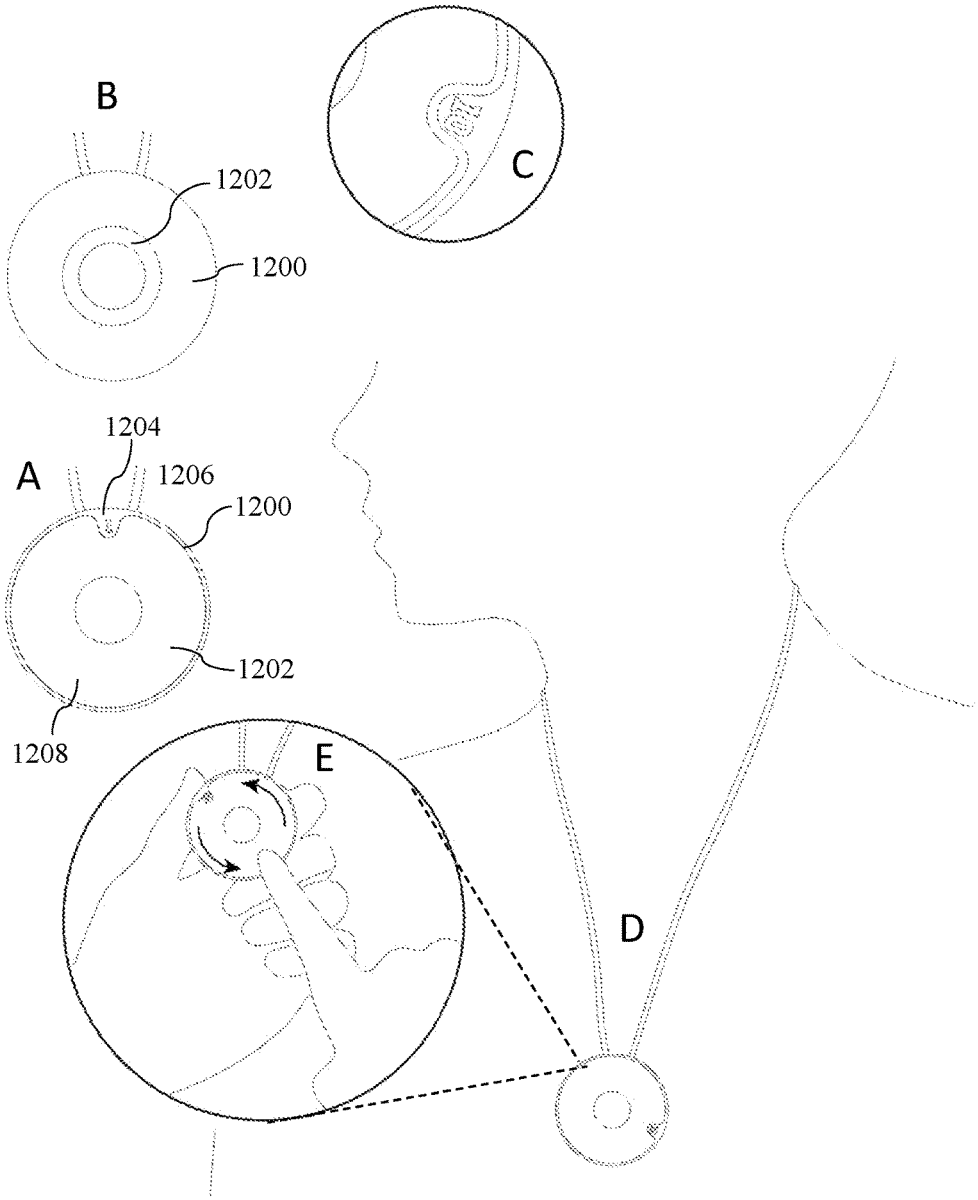
FIG. 12 illustrates a twelfth implementation of a wearable device.

FIG. 12 illustrates a twelfth implementation of a wearable device, similar to the implementation shown in FIG. 5. A front view is shown at A and a back view is shown at B. In this implementation, a first piece 1200 is substantially ring shaped with a front face, a back face, an inner circumference and an outer circumference. The first piece has indicia 1204 of the menstrual cycle, in the form of 27+/−3 counting measures in a circle on the front face. The second piece 1202 is a form of dial that interlocks with the first piece and is rotatable with respect to the first piece. The second piece can also be substantially ring shaped or cylindrical in shape. The first and second pieces can have complementary structures to provide for a snap fit between them. For example, as shown in the back view B, second piece 1202 can have a substantially cylindrical piece, with one or more protrusions, which is placed into a hole defined by the inner circumference of the first piece to snap into the first piece 1200. A marker, such as a notch or window on the dial, formed in the second piece, acts as a marker that reveals the current day on the menstrual cycle by highlighting one of the counting measures on the first piece, as shown in the magnified view C. Along the an outside circumference of the cylindrical piece of the second piece, detents or other mechanical features can be formed to mate with corresponding features formed on the inner circumference of the first piece, at spacing corresponding to the indicia on the first piece. Thus, each rotation of the second piece with respect to the first piece can snap into place so as to align the marker on the second piece with one of the indicia on the first piece. In this implementation other counting measures are hidden, and only the current counting measure is shown. The first piece can have a passage formed in it that allows the device to be placed on a cord, chain, rope or the like, allowing it to be worn as a necklace as shown at view D. A control surface 1208, which can be an indentation as shown, or other differentiation in the surface of the face of the second piece, provides a mechanism for turning the second piece, as shown at view E. The first and second pieces can be made of hard plastic. In another embodiment of the device of FIG. 12, the second piece can have a substantially cylindrical shape having an inner circumference that engages with the outer circumference of the first piece. In this embodiment, the mating mechanical features alternatively can be formed on the inner circumference of the second piece and the outer circumference of the first piece. The outer circumference of the second piece also can include protrusions or other features that cause the second piece to snap fit with the first piece.

Figure 13:
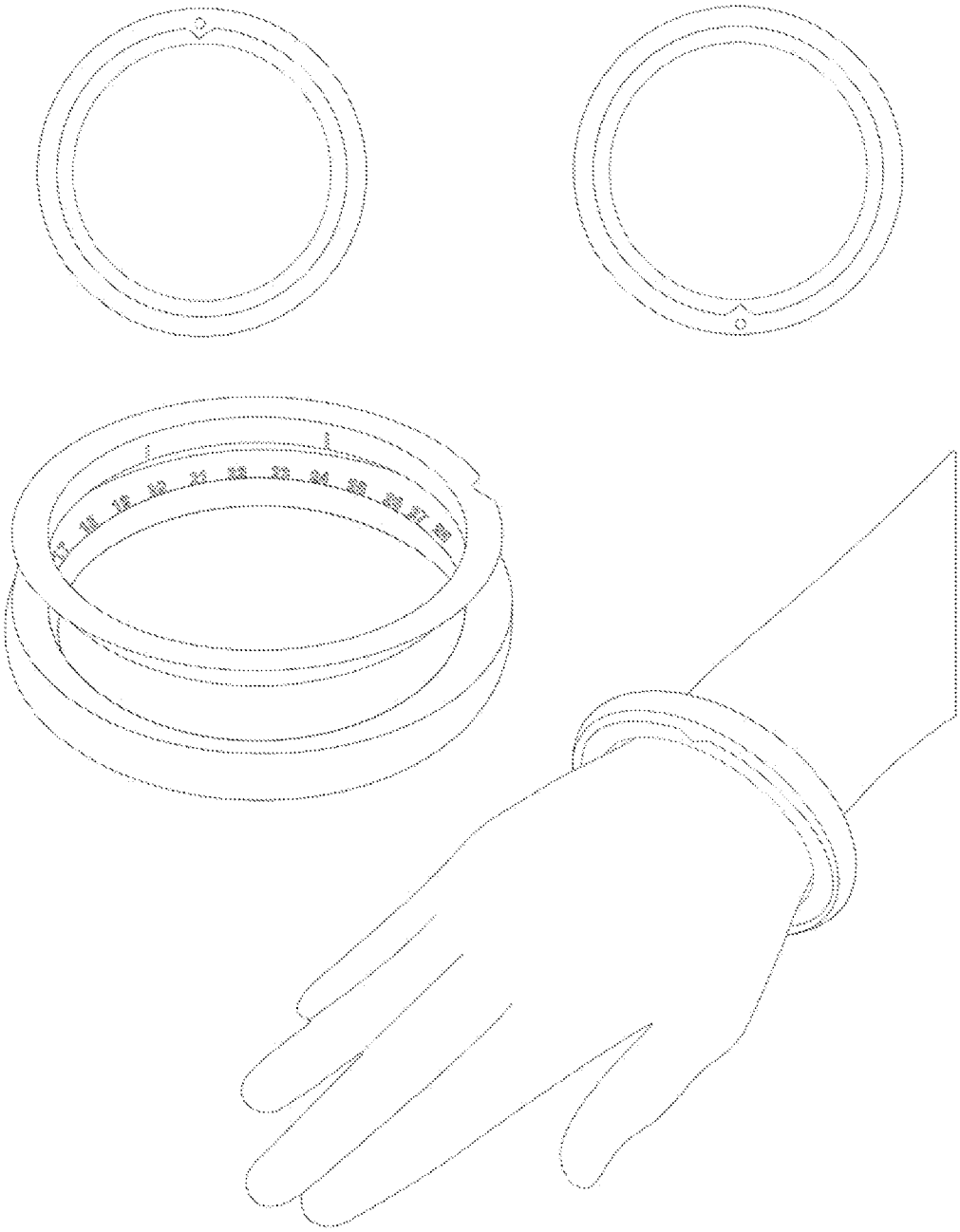
FIG. 13 illustrates a thirteenth implementation of a wearable device.

FIG. 13 illustrates a thirteenth implementation of a wearable device, similar to the implementation shown in FIG. 8. In this implementation, both a first piece and a second piece are interlocking ring shapes, and the pieces are rotatable with respect to each other. Thus the implementation in FIG. 13 also has characteristics similar to the interlocking ring shapes shown in FIG. 12. Edges and faces of the first and second pieces that interlock generally form a circle. Exterior edges can be otherwise ornamental. The first piece has indicia of the menstrual cycle, in the form of 27+/−3 counting measures in a circle or arc on a surface of the ring. The second piece interlocks with the first piece and is rotatable with respect to the first piece. A marker, such as a notch shape or raised dot marker or window on the second piece, reveals the current day on the menstrual cycle by revealing or pointing to one of the counting measures on the first piece. In this implementation other counting measures are hidden, and only the current counting measure is shown. The ring shape forms a passage allowing the device to be placed on a wrist, allowing it to be worn as a bracelet. The passage also allows the device to be placed on a cord, chain, rope or the like, allowing it to be worn as a necklace.

In the foregoing implementations, the counting measures can be numbers but also can be symbols and/or colors that are coded to indicate a current day in the menstrual cycle.

In the foregoing implementations, it should be understood the first and second pieces are interlocking and thus include a mechanism that maintains their relative position in the absence of mechanical action to move the first and second pieces. For example, a detent, cam or other mechanical structure can be part of the interlocking parts of the first and second pieces to maintain their relative position. By maintaining the relative position of these pieces, the counting measure referenced on the device remains selected until a mechanical action causes it to change. The device can include a sound generating circuit that is activated to produce a sound when the pieces are moved.

In the foregoing implementations, while they are described in terms of the second piece being movable with respect to the first piece, the first piece also can be considered movable with respect to the second piece.

Such devices can be formed of various materials such as plastics, fabrics and metals.

Any or all of the aforementioned alternate implementations described herein may be used in any combination desired to form additional hybrid implementations. It should be understood that the subject matter defined in the appended claims is not necessarily limited to the specific implementations described above. The specific implementations described above are disclosed as examples only.

What is claimed is:

1. A device for tracking a menstrual cycle, comprising:
- a first substantially ring shaped piece having:
  - a central aperture,
  - a passage that allows the device to be placed on a cord, chain, or rope and worn as a necklace, and
  - a front face,
  - wherein:
    - the front face of the first piece has indicia of the menstrual cycle,
    - wherein the indicia of the menstrual cycle:
      - is in the form of 27+/−3 measures, each to indicate a day in the menstrual cycle, arranged in a circle, and
- a second substantially ring shaped piece having:
  - a central aperture, generally concentric with the central aperture of the first piece,
  - a front face,
  - indentation on the front face of the second piece providing means for a user to rotate the second piece about the central aperture, and
  - an outer circumference
  - wherein the second piece:
    - is in the form of a dial that interlocks with the first piece, and
    - is rotatable with respect to the first piece, and
    - is positioned over the front face of the first piece, and
    - has a single marker comprising a notch or window into the outer circumference of the second piece that allows only one measure of the 27+/−3 measures on the front face of the first piece to be visible,
  - whereby,
    - when the device is in use, only one measure of the 27+/−3 measures is visible and the other measures of the 27+/−3 measures are hidden by the second piece, and no other indicia as to the menstrual cycle is visible.

2. The device of claim 1, wherein the measures are counting measures.

3. The device of claim 1 wherein the measures are icons, symbols or colors coded to indicate days of the menstrual cycle.

4. A necklace comprising cord, chain, or rope and the device of claim 1, wherein the device is on the cord, chain, or rope.

5. A device for tracking a menstrual cycle, consisting of:
a first substantially ring shaped piece, and
a second substantially ring shaped piece,
wherein:
said first and second pieces have complementary structures and snap fit together,
said first piece comprising:
a central aperture,
a passage that allows the device to be placed on a cord, chain, or rope and worn as a necklace, and
a front face,
wherein:
the front face of the first piece has indicia of the menstrual cycle,
wherein the indicia of the menstrual cycle:
is in the form of 27+/−3 measures, each to indicate a day in the menstrual cycle, arranged in a circle, and
said second piece comprising:
a central aperture, generally concentric with the central aperture of the first piece,
a front face,
indentation on the front face of the second piece providing means for a user to rotate the second piece about the central aperture, and
an outer circumference
wherein the second piece:
is in the form of a dial that interlocks with the first piece, and
is rotatable with respect to the first piece, and
is positioned over the front face of the first piece, and
has a single marker comprising a notch or window into the outer circumference of the second piece that allows only one measure of the 27+/−3 measures on the front face of the first piece to be visible,
whereby,
when the device is in use, only one measure of the 27+/−3 measures is visible and the other measures of the 27+/−3 measures are hidden by the second piece, and no other indicia as to the menstrual cycle is visible.

6. A necklace comprising cord, chain, or rope and the device of claim 5, wherein the device is on the cord, chain, or rope.

7. The device of claim 5, wherein the measures are counting measures.

8. The device of claim 5, wherein the measures are icons, symbols or colors coded to indicate days of the menstrual cycle.

* * * * *